US005497596A

United States Patent [19]

Zatkulak

[11] Patent Number: 5,497,596

[45] Date of Patent: Mar. 12, 1996

[54] METHOD FOR REDUCING PENETRATION OF LIQUID THROUGH NONWOVEN FILM-FIBRIL SHEETS PIERCED BY FASTENING ELEMENTS

[75] Inventor: Tony D. Zatkulak, Midlothian, Va.

[73] Assignee: E. I. Du Pont de Nemours and Company, Wilmington, Del.

[21] Appl. No.: 186,948

[22] Filed: Jan. 27, 1994

[51] Int. Cl.[6] ..... E04B 1/66

[52] U.S. Cl. ..... 52/746.1; 52/408; 52/410; 52/411

[58] Field of Search ..... 52/408, 746, 410, 52/411, 746.1

[56] References Cited

U.S. PATENT DOCUMENTS 5,091,235 2/1992 Vergnano ..... 52/408 X 5,134,831 8/1992 Avellanet ..... 52/408 X 5,365,709 11/1994 Lassiter ..... 52/408

*Primary Examiner*—Carl D. Friedman

*Assistant Examiner*—Christopher Todd Kent

[57] ABSTRACT

A method for reducing penetration of a liquid through flexible nonwoven, preferably film-fibril, sheets that have been pierced by one or more fastening elements. The method comprises discontinuously coating a hydrophobic foam in strips onto one side of a nonwoven film-fibril sheet to form a composite structure. The composite structure, preferably the foam side, is positioned against the outside surface of the framing structure of a building such that the foam strips align with the studs of the building. The facing material is then secured by one or more fastening elements through the composite structure. The nonwoven sheets with foam strips provide resistance to air infiltration and liquid penetration between the interior of the building and the surrounding environment.

4 Claims, 2 Drawing Sheets

METHOD FOR REDUCING PENETRATION OF LIQUID THROUGH NONWOVEN FILM-FIBRIL SHEETS PIERCED BY FASTENING ELEMENTS

FIELD OF THE INVENTION

The invention relates to a method for reducing penetration of liquids through sheets useful as a building housewrap. More particularly, the invention relates to a method for reducing water penetration through holes in such sheets from attachment means for the housewrap and siding.

BACKGROUND OF THE INVENTION

Wind-driven rain typically penetrates gaps in facing material on residential housing such as brick or brick veneer; stucco; metal, wooden or vinyl siding. Most building housewrap products resist water penetration except at the fastening sites (i.e. nail holes). Water can easily migrate through the nail holes and collect causing damage to the underlying internal support structure, i.e. the frame of the building. Damage includes mildew formation, as well as warping and rotting of the framing structure at the nail site and beyond.

A need exists for preventing liquids from passing through sheets of housewrap at the fastening site for the housewrap and siding.

SUMMARY OF THE INVENTION

According to the invention, there is provided a method for reducing penetration of liquid through a flexible nonwoven sheet which has been pierced by one or more fastening elements to fasten the sheet to a forming structure having a fastening element base.

The method includes discontinuously coating a hydrophobic foam onto a nonwoven substrate sheet, the foam being spaced in strips in a manner corresponding to a plurality of fastening element bases to form a composite structure; positioning the sheet against the framing structure such that the composite structure aligns with the fastening element bases of the framing structure; and fastening the sheet material through the composite structure in order to provide a resistance to liquid penetration between the fastening element bases and the surrounding environment.

Preferably, the foam side of the composite structure is against the framing structure. The most preferred substrate is a spunbonded sheet made from webs of polyethylene film-fibrils.

DETAILED DESCRIPTION OF THE ILLUSTRATED EMBODIMENT

Figure 1:
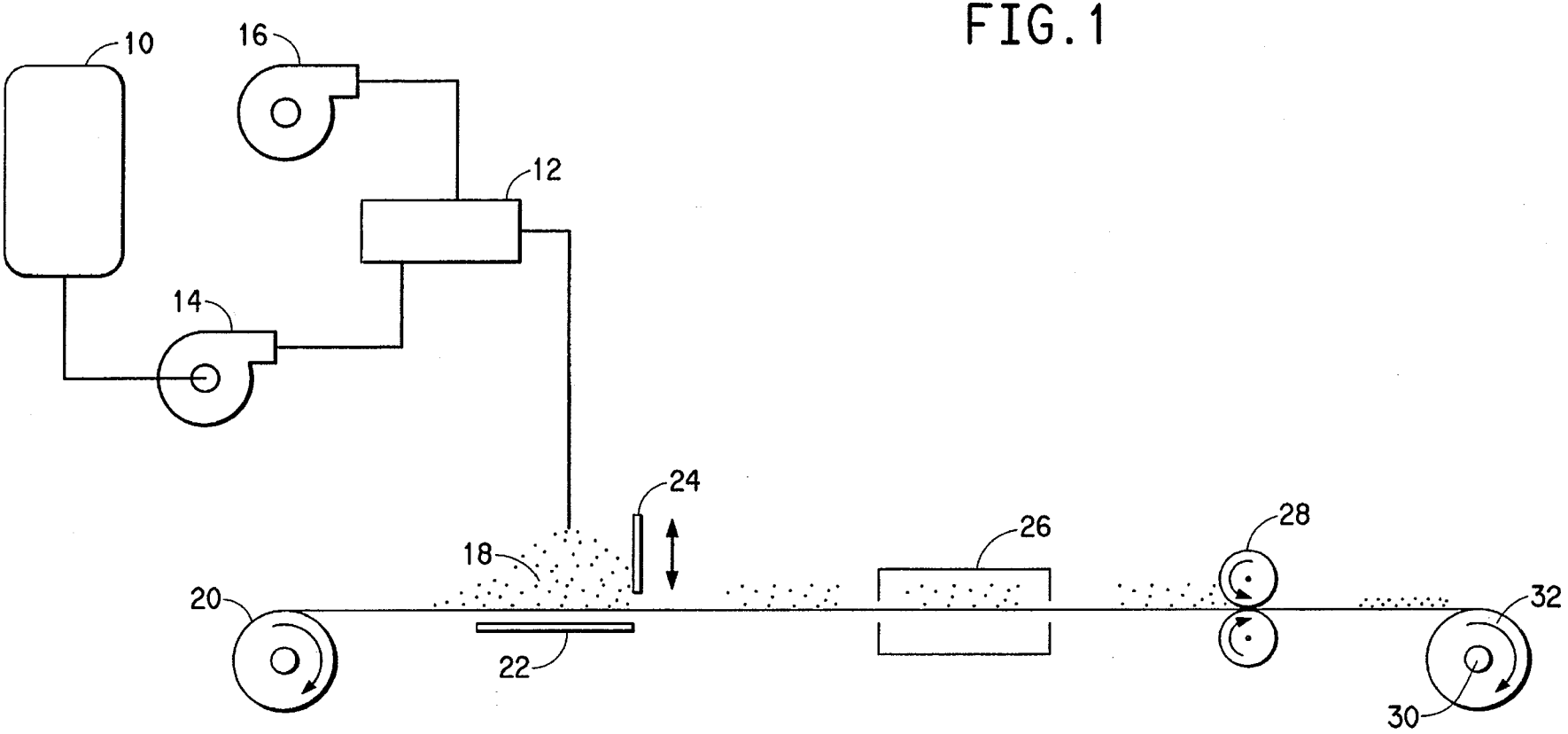
FIG. 1 is a schematic illustration of foam coating equipment suitable for use in the inventive method.

FIG. 1 shows a process line for discontinuously applying a foam coating to a flexible, nonwoven substrate sheet where the polymeric, foam-coating composition, held in supply tank 10, is fed to a conventional foamer 12 by pump 14. Foaming is produced by blending in compressed air from compressor 16 in the foamer. The resulting foamed polymeric froth 18 is applied to the nonwoven sheet 20 in a discontinuous manner on a support table 22 with doctor blade 24 controlling width and thickness of the applied foam and removing froth from the remainder of the nonwoven sheet. The discontinuously-coated sheet is then partially dried in a conventional oven 26, crushed to desired thickness between calendar rolls 28 and wound on a driven rotating roll windup 30 as a discontinuously foam coated sheet 32.

Figure 4:
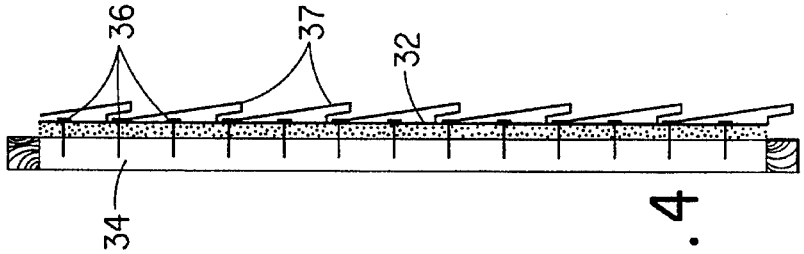
FIG. 4 is the cross section view of FIG. 3 with siding attached.
Figure 3:
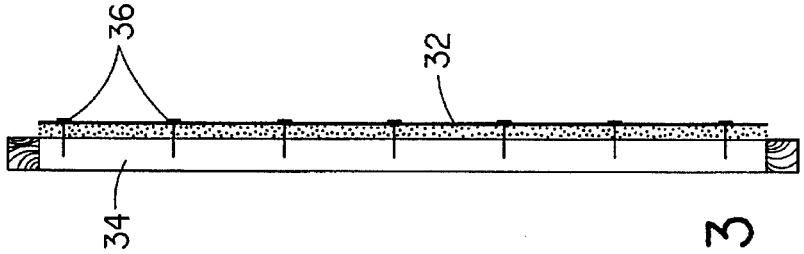
FIG. 3 is a cross sectional view of FIG. 2 taken along lines 3—3.
Figure 2:
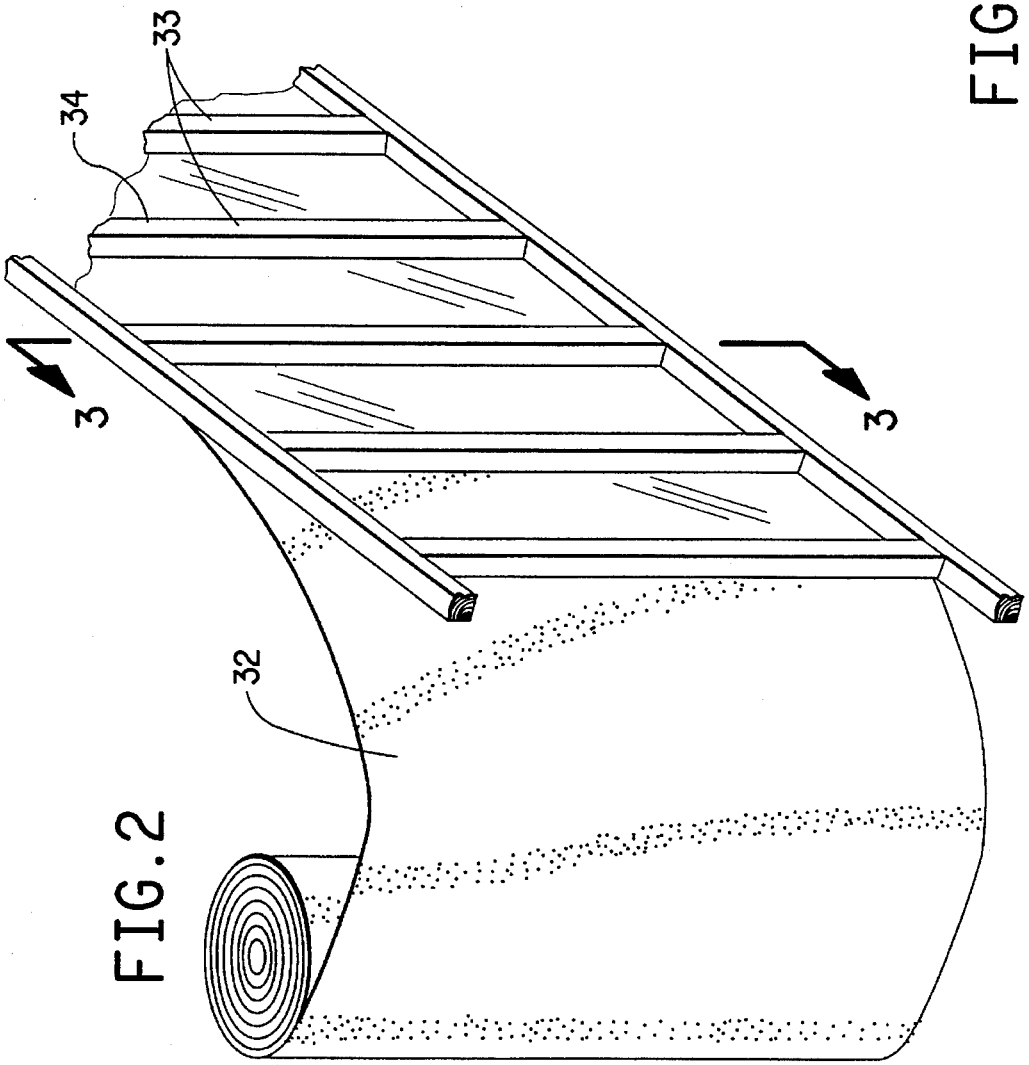
FIG. 2 is a perspective view of a framing structure of a building having the foam coated sheet of this invention fastened thereto.

FIG. 2 illustrates a discontinuously foam coated sheet product 32 fastened to a framing structure 33 having fastening element base 34 by means of fastening elements (e.g. roofing nails). As best shown in FIG. 3, the coated sheet product 32 is fastened to fastening element base 34 by means of nails or fastening elements 36. FIG. 4 illustrates additional nail holes in the housewrap caused by fastening the siding 37 to the nailing bases 34 through the housewrap.

In operation, a hydrophobic acrylic foam-coating composition, Rhone-Poulenc's Product Number MW 1145 (which yields a breathable foam), was placed in supply tank 10 at a temperature between 90° and 100° F. (Alternate foam coating compositions yielding breathable foam are available commercially as are foam coating compositions yielding non-breathable foam. Both are applicable to this invention although care must be taken to remove essentially all of the coating between the desired foam strips, especially when using a composition which gives a non-breathable foam.) The acrylic foam coating composition may be foamed or frothed by any known mechanical or chemical foaming process although in the preferred process foaming was accomplished by air whipping. In the preferred process, compressed air was blended with an acrylic foam compound in a conventional foamer 12, such as Oakes or Firestone foamer. In order to produce a coated substrate having desired properties, the volume ration of air to compound should be between 7:1 to 10:1.

The resultant acrylic froth (or foam) was then applied directly to a nonwoven substrate sheet, a spunbonded sheet known commercially as TYVEK® spunbonded olefin which is made from webs of polyethylene film-fibrils, having a unit weight of 1.5 oz/yd$^2$, in a discontinuous manner—such that a series of strips, preferably a regular distance apart and parallel are formed on the substrate. Typically, for use as a housewrap, the repeating distance is 16 inches to match the fastening element bases on the framing structure of a building. The applied foam should extend about ½ to 1 inch beyond the fastening element base in both directions to allow for misalignment during attachment to the framing structure. The method of applying the froth to the substrate is not critical, and any conventional method and apparatus known to the frothing art is suitable. For example, the froth may be applied to the substrate sheet while the sheet is moved across a support table 22 and the frothed coating may be leveled with a movable doctor blade 24 which is cylically raised and lowered, e.g. by use of a cam, to give the desired repeat distance, typically 16 inches for a housewrap product, and desired foam thickness. For purposes of the invention, a frothed coating thickness of between 0.045 to 0.055 inches is desired.

The frothed-coated sheet is then partially dried in a conventional dryer 26 to reduce the moisture content of the frothed coating to 10–15 wt. %. A gas-fired tenter frame with clips is suitable for this application. Care should be taken during the drying step to avoid curing of the coating.

The foam-coated sheet is then subjected to a crushing step to reduce the thickness of the foam to less than 25% of its original thickness. For this application, a crushed thickness of between 0.010 and 0.015 inches is desired. The crushing step can be accomplished by passing the foam-coated substrate through calendar 28 with a nip-roll arrangement such as that disclosed in U.S. Pat. No. 3,607,341. The nip is formed by a 10-inch-diameter metal roll above a 10-inch-diameter, 90 shore durometer, elastomeric covered roll.

In order to determine the improvement, a spray booth was constructed to model the effect of water penetration on housewrap by nailing the housewrap to a board through blotter paper and subjecting a test sample to a water spray. By weighing the blotter after the test and determining the amount of water which penetrated the test samples, test samples can be compared. Construction of the spray booth and the test are described below.

The spray booth has a positive displacement pump which is fed water from a large reservoir. The water discharged from the pump is directed by a manifold to four identical spray heads. These spray heads are essentially kitchen faucet nozzles which are mounted in such a way so that the spray is horizontally directed against the test samples. The samples are positioned vertically to accept the entire spray from one of the nozzles. The water which is deflected off the samples is collected and returned to the reservoir.

A sample is positioned over a pre-weighed sheet of blotter paper and mounted on a ½ inch thick piece of exterior plywood. The sample, blotter, and plywood support are sized to cover the entire spray pattern from one nozzle. A standard 1 inch long "roofing" nail is driven through the middle of the sample and blotter into the plywood support. The nail head is positioned ~¼" from the surface of the sample and centered in the spray pattern. Four samples are prepared and positioned opposite the four nozzles in the spray booth. The spray is started at a rate of 0.5 gallon/minute/nozzle (about 5 psig at the nozzle). The samples are rotated to a different nozzle position every 7.5 minutes until they are exposed to all four positions, a total of 30 minutes exposure per sample. Samples are then removed from the test booth. The nail is removed and the blotter paper re-weighed to determine the water pickup. This represents the relative amount of water which passes through the sample at the nail hole. The improvement can be expressed as a percentage.

TYVEK® spunbonded olefin, Style 1055B (a commercially available housewrap product), with and without the acrylic foam strips applied according to the described procedure was tested for water penetration in the spray booth following the described test procedure. Water penetration was reduced by 40% if the nails were inserted through the TYVEK® housewrap/acrylic-foam composite structure compared to the TYVEK® housewrap alone.

What is claimed is:

1. A method of reducing penetration of liquid through a flexible nonwoven sheet which has been pierced by one or more fastening elements to fasten the sheet and siding to a framing structure having a plurality of fastening element bases, comprising the steps of:

(a) providing a nonwoven sheet having a coating of hydrophobic foam on a surface of the sheet, the foam being spaced in strips in manner corresponding to the plurality of fastening element bases;

(b) positioning the sheet against the framing structure such that the foam aligns with the fastening element bases of the framing structure; and (c) fastening the sheet to the fastening element bases through the foam with a fastening element in order to provide a resistance to liquid penetration between the sheet and the fastening element.

2. The method of claim 1 in which the foam is against the framing structure.

3. The method of claim 1 in which the nonwoven substrate is a spunbonded sheet.

4. The method of claim 3 in which the spunbonded sheet is made from webs of polyethylene film-fibrils.

* * * * *